US006807891B2

(12) United States Patent
Fisher

(10) Patent No.: US 6,807,891 B2
(45) Date of Patent: Oct. 26, 2004

(54) FLEXIBLE IMPACT-RESISTANT MATERIALS

(75) Inventor: Stephen E. Fisher, Athens (GR)

(73) Assignee: Armotec Incorporated, Dimitrios (GR)

( * ) Notice: Subject to any disclaimer, the term of this patent is extended or adjusted under 35 U.S.C. 154(b) by 0 days.

(21) Appl. No.: 10/298,692

(22) Filed: Nov. 19, 2002

(65) Prior Publication Data

US 2003/0064191 A1 Apr. 3, 2003

Related U.S. Application Data

(63) Continuation of application No. 09/720,517, filed as application No. PCT/EP99/04386 on Jun. 24, 1999, now Pat. No. 6,500,507.

(30) Foreign Application Priority Data

Jun. 25, 1998 (EP) ..... 98600010

(51) Int. Cl.[7] ..... B32B 3/10

(52) U.S. Cl. ..... 89/36.02; 428/49; 428/911; 2/2.5

(58) Field of Search ..... 428/47, 48, 49, 428/911; 2/2.5; 89/36.02

(56) References Cited

U.S. PATENT DOCUMENTS

| | | | | | |
|---|---|---|---|---|---|
| 3,516,898 | A | * | 6/1970 | Cook | 428/49 |
| 3,523,057 | A | | 8/1970 | Buck | |
| 3,607,607 | A | * | 9/1971 | Beninga | 156/298 |
| 3,867,239 | A | | 2/1975 | Alesi et al. | |
| 4,923,728 | A | | 5/1990 | Snedeker | |
| 5,738,925 | A | | 4/1998 | Chaput | |
| 6,500,507 | B1 | * | 12/2002 | Fisher | 428/36.1 |

FOREIGN PATENT DOCUMENTS

| | | |
|---|---|---|
| DE | 3910602 A1 | 6/1990 |
| WO | WO 93/21492 | 10/1993 |

* cited by examiner

*Primary Examiner*—Alexander S. Thomas
(74) *Attorney, Agent, or Firm*—Birch, Stewart, Kolasch & Birch, LLP

(57) ABSTRACT

Flexible impact- or blast-resistant composite material including a strike-face having impact-resistant, adjacent tiles which have complementary mating edges, and a flexible material having at least one layer, the material having a high resistance to local deformation and by itself being of non-ballistic properties, wherein the tiles of the strike-face are integral with the flexible material.

18 Claims, 2 Drawing Sheets

FLEXIBLE IMPACT-RESISTANT MATERIALS

This application is a continuation of application Ser. No. 09/720,517, filed on Apr. 24, 2001, now U.S. Pat. No. 6,500,507 and for which priority is claimed under 35 U.S.C. §120. application Ser. No. 09/720,517 is the national phase of PCT International Application No. PCT/EP99/04386 filed on Jun. 24, 1999 under 35 U.S.C. §371. The entire contents of each of the above-identified applications are hereby incorporated by reference. This application also claims priority of Application No. 98 600 010.7 filed in Europe on Jun. 25, 1998 under 35 U.S.C. §119.

TECHNICAL FIELD

The invention relates to impact-resistant materials, in particular of the type suitable for ballistic protection

BACKGROUND OF THE INVENTION

The widespread availability of guns, rifles, pistols knives and other assorted equipment which characterises the last part of this century, has given rise to an increased demand for materials to protect both humans and equipment against these hazards.

Historically, the development of weapons has been followed by a respective development of armour systems to defeat them. A more advanced, penetrative weapon, or a cutting implement harder than the armour, require heavier armour to defeat it. Typically, heavier armour has a number of significant disadvantages. In the case of body or vehicle armour, higher weight reduces mobility. Heavier armour also tends to be bulkier and less flexible, which is a problem in particular with armoured vests. In general, armouring material is expensive and using more, increases both weight and cost of the product.

Armour producers were among the first to use advanced, high-strength lightweight materials such as fabrics comprised of aramid fibres, ultra-high molecular weight polyethylene fibres, carbon fibres and liquid crystal polyester fibres, as well as high density, lightweight, hard materials, such as titanium, alumina oxide-, boron carbide-, silicon carbide- and metal matrix-ceramics, and ultra hard metals.

In order to achieve the desired protective properties, selected materials have often been combined with each other in layer-like fashion.

One of the most successful multi-layer types of materials for use against high energy impacts, such as those caused by high-velocity rifle bullets, employs a strike-face comprising the hardest available material within weight/cost constraints in a multiple-tile configuration The tiles can be made of ceramic, metal, plastic, metal alloys, rapid solidification (RSM) materials or metal or ceramic foams. The strike-face layer is applied (e.g. by mechanical fixing, lamination or gluing) upon a stiff energy absorbing material which may be a metal or plastic layer, or layers of softer material such as the high-tech fabrics mentioned above, or combinations thereof. These fabrics must be consolidated by a lamination process employing various resins, e.g. phenolic-, polyester-, vinylester-, epoxy-, polyethylene-, polycarbonate- or other suitable resins.

The most commonly employed material illustrating the state of the art strike face would be boron carbide ceramic tiles. Known tile shapes are square, rectangular, hexagonal or diamond. The tiles are arranged side by side, in a multiple tile configuration with mating edges, adhered to an ultra-high molecular weight polyethylene (UHMW PE) laminate. The thickness and density of both the ceramic and laminate are engineered to be sufficient to defeat the specified threat.

Functionally, when the ceramic tile (strike-face) is impacted it destroys the penetrative ability of the impactor by radical deformation and, should the impactor have sufficient remaining energy to pass beyond the ceramic tile, the minor remaining energy is absorbed by the laminate. The intimate adhesion of the ceramic to the laminate is of primary importance since unsupported ceramic is by nature brittle and requires a rigid backing support. The absence of such a support would cause the resistance to decrease significantly, leading to failure to meet the desired level of impact-resistance. Another requirement of such a construction is for the mating edges to be placed tightly against one another, in case the impactor strikes the joint of two or more tiles. Such a construction is necessarily rigid and inflexible, if it is to satisfy accepted specifications, for example, United States National Institute of Justice (USNIJ) 0101.03 Ballistic Standard or other National Standards for ballistics or impact, such as the United Kingdom's Police Scientific Development Branch (PSDB) Stab-resistant Body Armour Test Procedure 10/93.

U.S. Pat. No. 3,867,239 is directed to an armour construction with an array of platelets contoured edges wherein the construction uses an overlapping stepped joint construction to improve the protection at the joints. This construction reduces flexibility.

There is therefore a need for a material utilising an appropriate strike face, whilst at the same time remaining flexible.

SUMMARY OF THE INVENTION

The invention is particularly, but not exclusively, applicable in the ballistic protection field. The invention is largely based on the construction of a supportive layer behind the strike face tiles which is made to be of non-ballistic properties, yet still have a high resistance to local deformation.

In this regard, it should be noted that the material "being of non-ballistic properties" means that the flexible material layer (which may itself comprise one or more layers), is by itself unable to meet any international ballistics standard. The lowest internationally recognised ballistics standard can, for the purposes of this invention, be regarded as the "CEN 1063 standard for bullet resistance of glazing: handguns and rifles—BRI calibre 0.22 inch (5.59 mm) long rifle". The flexible material layer of non-ballistic properties according to the invention thus has ballistics resistance properties which are in the range of about 2% to 50% of the aforementioned lowest ballistic standard, preferably between about 5% and 50% of said standard, more preferably between about 10% and 35% of said standard, and most preferably between 15% and 25% of said standard. As such, the flexible material would not have any recognised or useful ballistic resistance by itself.

According to the invention, there is provided a flexible impact- or blast-resistant composite material.

Due to the complementary mating edges, the tiles are easily placed in an abutting relationship without a gap therebetween.

The flexible material acts as a support for the strike face tiles, while maintaining desired flexibility properties.

By "strike-face" is meant that side of the material which is intended to resist an attack. This is the layer which is first struck by the impactor.

By "high resistance to local deformation" is meant a material which produces an indentation of 10 mm or less when subject to a local deformation test as hereinafter described.

By "integral with" is meant any manner by which the tiles are made one with the flexible material, including chemical and mechanical attachments including combinations thereof, such as adhering and/or encapsulating.

The invention also relates to impact resistant tiles. Such tiles are suitable for use with ballistic or impact resistant materials.

The tiles may have a shape such that when a plurality of identical tiles are suitably placed adjacent each other they form a continuous surface. It is also possible to make mating combinations of tiles having different shapes.

The tiles may be planar with one of the following shapes square (a), rectangular (b), hexagonal (c), diamond (d), double hexagonal (e), butterfly (f), chevron (g) half-trapezium (h), stretched hexagon (i), trapezium (j), rectangle with curved shorter ends curved in same direction (k), T-shape (l), segment of circle with radii in the form of curves with the same radius as the circle (m), butterfly (n), or complex rhombic.

The shapes of the tiles may preferably have corners greater than 90 degrees and when the tiles are arranged side by side, have a maximum of three tiles at an intersection.

The tiles may be non-planar and have one of the following shapes: cylindrical (p), pyramid (q), truncated pyramid (r) or angle shape (s).

Suitably the tiles may comprise ceramic tiles, preferably boron carbide ceramic.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

Figure 1:
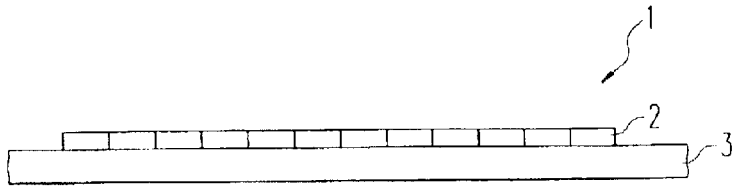
Fig. 1 (prior art)
FIG. 1 is a drawing of a prior art composite construction.

FIG. 1 shows a typical prior art construction having a strike-face 1 formed of a plurality of impact-resistant tiles 2 and a stiff inflexible composite backing 3 of good ballistics properties.

Figure 2:
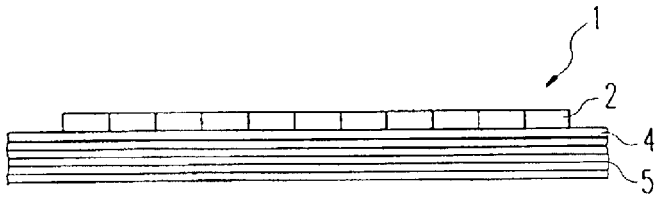
FIG. 2 is a drawing of a composite construction according to one embodiment of the invention.

A first embodiment of the material of the invention is shown in FIG. 2 wherein the strike face 1 is formed of a plurality of impact-resistant tiles 2 which are integral with a flexible layer 4.

The impact-resistant tiles can be made of any one of a number of suitable materials which include ceramic, metal, plastics, metal alloys, rapid solidification (RSM) materials or metal or ceramic foams. A preferred example is boron carbide ceramic tiles. A ceramic tile may consist of a material with velocity of propagation of sound waves greater than 5000 metres per second.

A tile may include a matrix in the form of a metallic mesh for deterring the propagation of fractures.

A further refinement of the multi-layer armour according to the invention involves the use of particular tile shapes matched to an appropriate flexible layer, in order to meet various design objectives, resulting from different standards to be met and from the desired degree of flexibility. Generally, the smaller the individual tile, the smaller the bending radius of the multi-layer flexible composite. Preferred tile geometries have corners greater than 90 degrees and when arranged side by side, have a maximum of three tiles at an intersection.

Figure 3:
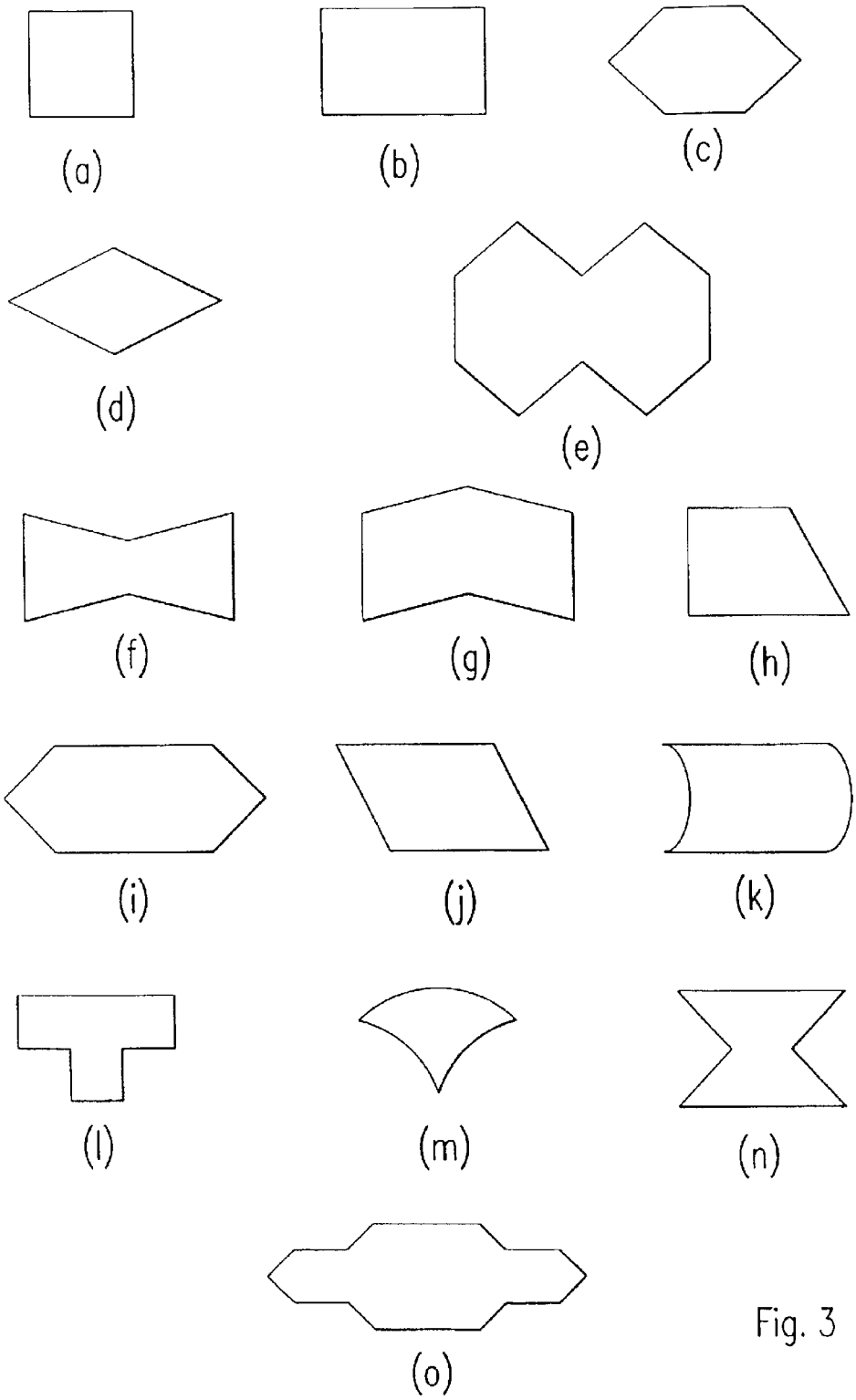
FIGS. 3(*a*)–3(*o*) depict plan views of various tile shapes according to the invention.

The tiles 2 may have any suitable shape as shown in FIG. 3 including square (a), rectangular (b), hexagonal (c), diamond (d), double hexagonal (e), butterfly (f), chevron (g) half-trapezium (h), stretched hexagon (i), trapezium (j), rectangle with curved shorter ends curved in same direction (k), T-shape (l), segment of circle with radii in the form of curves with the same radius as the circle (m), butterfly (n), or complex rhombic shape (o). The shapes may be such that when appropriately placed with other identically shaped tiles their edges mate, so that the tiles form a continuous surface. It is also possible with some shapes of tiles to mix tile shapes to produce mating edges and a continuous surface. For instance shapes (c), (i) and/or (f) may be combined, or shapes (f) and (g) etc.

Figure 4:
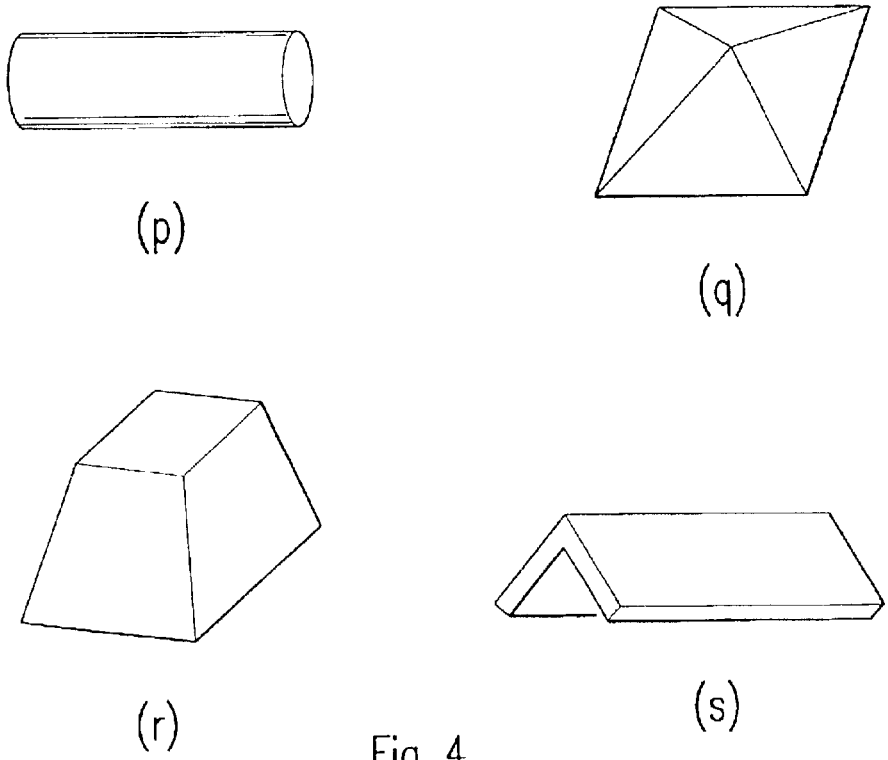
FIGS. 4(*p*)–4(*s*) depict perspective views of further tile shapes according to the invention.

The tiles may also have a three-dimensional shape such, for example, as illustrated in FIG. 4. The tiles are illustrated having a cylindrical (p), pyramid (q), truncated pyramid (r) or angle shape (s). The tile according to examples (p) to (r) may be formed hollow or solid.

The above description of the shapes of tiles is only illustrative, any suitable shape being usable in the invention. Also different shapes of tiles may be used in different areas of the material so as to produce differing properties in these differing areas.

Suitable materials for the flexible material layer 4 include any material having the properties of high resistance to local deformation, but by itself having non-ballistics properties. Such materials include woven and non-woven fabrics including high strength woven materials such as aramid fabric having one or more layers, in particular two or more layers, for example up to five layers, but typically less than ten layers. Alternatively, the flexible material can be a metallic layer, in particular wire-mesh, e.g. plain weave wire-mesh. The wire-mesh may be formed from a high-carbon heat-treated metal. Another suitable material is an ionomer such as made by Du Pont under the trade name SURLYN. The material may have a modulus of 50-GPA or a tensile strength of 20-6000 MPA.

Another method of developing a flexible layer suitable for the application of tiles is by deposition onto a backing surface which may or may not have ballistic properties. For example, a metal or ceramic layer can be applied on a Kevlar® fabric surface by a plasma spray process. The metal or ceramic in wire or powdered form is vaporised and deposited on the fabric layer in multiple applications to build-up the desired thickness. The impact or blast-resistant tiles are then made integral with the flexible layer Other means of flexible layer production would be injection, mechanical, electrical, pneumatic, ultrasonic, chemical or by any other means known in the art.

Materials suitable for the flexible layer also include woven structures, unidirectional lay-up, three dimensional structures (for example honeycomb structures), homogenous films or sheets, or combinations thereof, of natural, synthetic, or high-density fibres, ribbons, tubes, or multi-contoured extrusions or laminated layers, or ceramic, metallic, or plastic (thermoplastic or thermoset) materials of the above-mentioned construction that has sufficient resistance to deformation in small areas while maintaining flexibility as a layer over larger areas. Whatever the construction of the at least one layer of flexible material, non-ballistics properties are present in said flexible material when taken alone, making said flexible material generally light (in terms of weight) and also allowing a high degree of flexibility compared to materials having ballistics properties.

In a second embodiment of the invention a backing layer 5 is provided for the flexible material. The backing layer may be formed of soft, semi-rigid, or rigid energy absorbing material. Suitable materials may include woven multi-layer aramid fabrics, particularly ten or more layers, and more particularly thirty or more layers. In this way, the backing layer is given recognised ballistics properties (at least sufficient to fulfill the aforementioned CEN standard) and the flexible material therefore forms an intermediate material layer between the backing layer and the strike face tiles. The backing layer may be attached to the flexible material or it can merely be held in contact therewith without being attached thereto. Such a construction provides very good overall ballistics properties yet still maintains flexibility due to the intermediate flexible material layer attached to the tiles.

The following examples of materials represent preferred embodiments of the invention.

In a first example, particularly useful against low-energy threats, such as those presented by an attacker using a knife or other pointed object, the composite material according to the invention involves a strike-face of low-density ceramic tiles forming a strike face with an intermediate layer of laminated aramid fabric layers (forming the flexible material), backed by multiple layers of a ballistic-quality (i.e. of ballistic properties according to at least the aforementioned CEN standard) aramid fabric. Samples of this composite construction were found to meet and exceed the requirement of the PSDB Stab Resistant Armour Test Specification (1993).

Construction details and material specifications for this example are as follows: Alumina oxide hexagonal tiles, of 85% purity, 2 mm thick, 15 mm width from edge to edge, (with a 5 mm diameter hole in the centre), bonded with a solvent based rubber adhesive, to six (6) layers of plain weave aramid fabric (440 g/m$^2$), which were first laminated together with a polyurethane adhesive.

In a second example of the material according to the invention high-density ceramic tiles were mated with a flexible metallic layer (flexible material layer) and backed by multiple layers of ballistic-quality aramid fabric. Testing according to US NIJ (National Institute of Justice) Standard 101.03 of 1987, resulted in a compliance with the Level III of the standard with flexibility mimicking that of typical Level III-A soft armour vests.

Construction details and material specifications for this example are as follows: Alumina oxide hexagonal tiles, of 99.5% purity, 6 mm thick, 20 mm width from edge to edge, bonded with a polymer adhesive to a high-carbon heat-treated plain-weave wire-mesh, with wire thickness of 0.65 mm and square openings of 1.4 mm, in turn bonded to one layer of plain weave aramid fabric (440 g/m$^2$) and in turn backed by fifty (50) layers of plain weave aramid fabric (215 g/m$^2$).

In a third example, the material according to the second example was enhanced by additional layers of aramid material positioned relative to the wire mesh in such a way that the layer comprised a metallic/aramid composite.

A vest insert sample of dimensions 330 by 260 mm was placed in front of a typical US NIJ Level III-A soft armour 450 by 400 mm panel (representative of a typical prior art vest) and had a penetrative V50 limit, in extreme excess of US NIJ III standards.

Construction details and material specifications for this third example are as follows:

Alumina oxide hexagonal tiles, of 99.5% purity, 6 mm thick, 20 mm width from edge to edge, bonded with a polymer adhesive to a pressed laminate consisting of plain weave aramid fabric (440 g/m$^2$), high-carbon heat-treated plain weave wire mesh, with wire thickness of 0.65 mm and square openings of 1,4 mm, and another layer of aramid fabric (440 g/m$^2$), with the laminating resin being a silicone-based adhesive. This multi-layer laminate was in turn backed by thirty-six (36) layers of plain weave aramid fabric (215 g/m$^2$).

A further embodiment of the invention which meets and exceeds the requirements of the British PSDB combined ballistic (HG 1) and stab-resistant (KR 65) standards, was tested and has the following construction characteristics:

Alumina oxide hexagonal tiles, of 95% purity, 2.4 mm thick, 20 mm width from edge to edge, bonded with a polymer adhesive to a laminate of four layers of aramid fabric, bonded with a vinyl-based resin with laminate weight being approx. 1000 g/m$^2$. This multi-layer composite is in turn backed by 34 layers of uni-directional UHMW polyethylene composite fabric (150 g/m$^2$), a 7 mm thick polyethylene foam and a further laminate of four layers of aramid fabric bonded with vinyl based resin.

The above examples illustrate that by following the teaching of the invention, various impact resistant materials are provided which can be tailored to meet international standards, while maintaining a degree of flexibility and low weight previously not attainable by prior art devices. One of the significant deviations from prior art impact-resistant materials is that according to the invention, the flexible material upon which the strike-face tiles are adhered, or formed, typically does not have significant ballistic properties by itself (as described previously), i.e. it is not a material that meets the requirements of the aforementioned "CEN standard for bullet resistance of glazing: handguns and rifles—BRI calibre 0.22 inch (5.59 mm) long rifle" or any other international or national ballistic standards, such as STANAG 2920 or US-NIJ 0101.03 Level 1, or which are currently considered the lowest requirement for fragmentation or ballistic protection. However, the flexible material needs to be of the type that shows high resistance to local deformation.

The established way of measuring the resistance to local deformation which is used in this invention is according to the following procedure, most of which are drawn from current international standards for measuring shock in ballistic materials: A squared rigid frame box measuring internally 420 mm by 420 mm by 150 mm, closed on one side, shall be filled with backing material (found to be suitable is "Roma Plastilina" No. 1 modelling clay, available from Sculpture House Inc., 38 East 30th Str., New York, N.Y. 10016 and other artist supply centres), ensuring that it contains no air pockets or imperfections that may affect the indentations created by the impact of a bullet. The temperature of the block during the test shall be such that when a 1.03 kg steel ball with a diameter of 63.5 mm is dropped from a vertical height of 2 m above the surface of the backing material, the depth of the indentations achieved from three such drops should each be 20 mm±1 mm. The flexible single or multiple layer material is placed on the surface of the backing material with intimate contact between the backing material and all portions of the rear surface of the test material. The steel ball used to measure backing material consistency shall be dropped from a vertical height of 30 cm above the surface of the test material The flexible test material shall be considered appropriate for use with the invention if an indentation depth of 10 mm or less is measurable in the backing material.

The invention can be applied to a wide variety of uses. By varying the thickness of the tiles and with the appropriate manner of tile attachment to the flexible material supporting the tile, the resulting construction can be made capable of "long duration impact", which is a load-bearing construction. With tiles of suitable geometry arranged side by side and appropriately attached to a flexible layer resistant to local deformation, upon loading, the edges press against each other and transmit load energy to attachment points/plains/surfaces, in a manner perpendicular to the tile surfaces. One use of such an arrangement is as a stretcher, for example a portable stretcher for injured people. With hand loops at each corner, the unit, when unrolled, would support weight in accordance with the strength of the attachment system, the flexible base layer and the size and design quality of the tiles.

Various other applications associated to the armour field present themselves. Particular examples of such applications include: micrometeorite shielding, bite resistant clothing for animal trainers and underwater divers, impact resistant clothing for dangerous sports, chainsaw/cut resistant clothing, flexible portable radiation shielding (using boron carbide tiles as neutron absorbers), and explosive blast repression constructions.

The materials of the invention may also be in the form of panels. The panels may be used in vehicles which require protection from ballistic threats.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A flexible impact- or blast-resistant composite material comprising:

a strike face comprising impact-resistant, adjacent tiles having complementary mating edges, the strike-face having a strike face surface and a reverse surface, and a flexible material by itself being of non-ballistic properties and having at least one layer, wherein the tiles of the strike-face are integral with the flexible material, the flexible material being adjacent the reverse surface of the strike-face, the flexible material having a high-resistance to local deformation measured in accordance with the following test, in which:

a square rigid frame box measuring internally 420 mm by 420 mm by 150 mm, closed on one side, is filled with backing material ensuring that the material contains no air pockets or imperfections that would affect the indentations created by the impact of a bullet, the temperature of the block during the test being such that when a 1.03 kg steel ball with a diameter of 63.5 mm is dropped from a vertical height of 2 m above the surface of the backing material, the depth of the indentations achieved from three such drops should each be 20 mm ±1 mm, the flexible material is placed on the surface of the backing material with intimate contact between the backing material and all portions of the rear surface of the test material; and the steel ball used to measure backing material consistency is dropped from a vertical height of 30 cm above the surface of the test material; indentation having a depth of 10 mm or less in the backing material; and the backing material being modeling clay.

2. The material of claim 1, wherein the adjacent tiles of the strike-face are side-by-side.

3. The material of claim 1, wherein the modeling clay is non-hardening oil and sulphur based modeling clay.

4. The material of claim 1, wherein the flexible material comprises a high strength woven material.

5. The material of claim 1, wherein the flexible material comprises a material having a modulus of 50–500 GPA, or a tensile strength of 20–6000 MPA.

6. The material of claim 1, further comprising a backing layer arranged adjacent the flexible material on a side opposite to the strike face surface, the backing layer being formed of energy absorbing material and said backing layer having ballistic properties.

7. The material of claim 1, wherein the impact-resistant tiles comprise ceramic tiles.

8. The material of claim 7, wherein the tiles contain a material with velocity of propagation of sound waves greater than 5000 meters per second.

9. The material of claim 1, wherein at least some of the impact-resistant tiles have a shape such that when a plurality of identical tiles are placed adjacent each other, the adjacent tiles form a continuous surface.

10. The material of claim 9, wherein at least some of the tiles are planar with one of the following shapes, square, rectangular, hexagonal, diamond, double hexagonal, butterfly, chevron, half-trapezium, stretched hexagon, trapezium, rectangle with curved shorter ends curved in a same direction, T-shaped, segment of circle with radii in a form of curves with a same radius as the circle, butterfly or complex rhombic.

11. The material of claim 9, wherein at least some of the tiles are non-planar and have one of the following shapes: cylindrical, pyramid, truncated pyramid or angle shape.

12. The material of claim 1, wherein at least some of the tiles are planar with one of the following shapes, square, rectangular, hexagonal, diamond, double hexagonal, butterfly, chevron, half-trapezium, stretched hexagon, trapezium, rectangle with curved shorter ends curved in a same direction, T-shaped, segment of circle with radii in a form of curves with a same radius as the circle, butterfly or complex rhombic.

13. The material of claim 1, wherein at least some of the tiles are non-planar and have one of the following shapes: cylindrical, pyramid, truncated pyramid or angle shape.

14. The material of claim 1, wherein the flexible material comprises cavities, perforations or a three dimensional structure which forms cavities, the cavities or perforations holding the impact-resistant tiles.

15. The material of claim 14, wherein the tiles are encapsulated in the cavities or perforations.

16. The material of claim 1, wherein the adjacent tiles of the strike-face are side-by-side and wherein the material is a bullet-, puncture-, blast-, stab- or radiation-resistant vest or other wearable article.

17. The material of claim 1, wherein the adjacent tiles of the strike-face are side-by-side and wherein the material is used as a panel.

18. The material of claim 17, wherein the panel is in a vehicle or structure and wherein at least some of the impact-resistant tiles have a shape such that when a plurality of identical tiles are placed adjacent each other, the adjacent tiles form a continuous surface.

* * * * *